US008273512B2

(12) United States Patent
Tong et al.

(10) Patent No.: US 8,273,512 B2
(45) Date of Patent: Sep. 25, 2012

(54) PHOTORECEPTOR INTERFACIAL LAYER

(75) Inventors: Yuhua Tong, Webster, NY (US); Edward F. Grabowski, Webster, NY (US); Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 561 days.

(21) Appl. No.: 12/485,834

(22) Filed: Jun. 16, 2009

(65) Prior Publication Data

US 2010/0316410 A1 Dec. 16, 2010

(51) Int. Cl.
*G03G 15/00* (2006.01)

(52) U.S. Cl. ..... 430/64; 430/65; 430/58.8; 430/129; 430/60; 399/159

(58) Field of Classification Search ..... 430/58.8, 430/129, 64, 60
See application file for complete search history.

(56) References Cited

U.S. PATENT DOCUMENTS

| | | | | |
|---|---|---|---|---|
| 3,121,006 | A | | 2/1964 | Middleton et al. |
| 4,286,033 | A | | 8/1981 | Neyhart et al. |
| 4,291,110 | A | | 9/1981 | Lee |
| 4,338,387 | A | | 7/1982 | Hewitt |
| 4,387,980 | A | | 6/1983 | Ueno et al. |
| 4,464,450 | A | | 8/1984 | Teuscher |
| 4,587,189 | A | | 5/1986 | Hor et al. |
| 4,664,995 | A | | 5/1987 | Horgan et al. |
| 4,786,570 | A | | 11/1988 | Yu et al. |
| 4,921,773 | A | | 5/1990 | Melnyk et al. |
| 4,943,508 | A | * | 7/1990 | Yu ..... 430/129 |
| 5,051,328 | A | | 9/1991 | Andrews et al. |
| 5,069,993 | A | | 12/1991 | Robinette et al. |
| 5,089,908 | A | | 2/1992 | Jodoin et al. |
| 5,096,792 | A | | 3/1992 | Simpson et al. |
| 5,139,907 | A | | 8/1992 | Simpson et al. |
| 5,162,183 | A | | 11/1992 | Lindblad et al. |
| 5,210,548 | A | | 5/1993 | Grabowski |
| 5,215,839 | A | | 6/1993 | Yu |
| 5,302,485 | A | | 4/1994 | Swain |
| 5,460,911 | A | | 10/1995 | Yu et al. |
| 5,571,647 | A | | 11/1996 | Mishra et al. |
| 5,635,324 | A | | 6/1997 | Rasmussen et al. |
| 5,660,961 | A | | 8/1997 | Yu |
| 5,756,245 | A | | 5/1998 | Esteghamatian et al. |

(Continued)

FOREIGN PATENT DOCUMENTS

GB 2 258 737 A 2/1993

OTHER PUBLICATIONS

European Search Report dated Sep. 2, 2010, EP Application Serial No. 10165396.2, 3 pages.

*Primary Examiner* — Christopher Rodee
*Assistant Examiner* — Rashid Alam
(74) *Attorney, Agent, or Firm* — Pillsbury Winthrop Shaw Pittman LLP

(57) ABSTRACT

The presently disclosed embodiments relate generally to layers that are useful in imaging apparatus members and components, for use in electrostatographic, including digital, apparatuses. Embodiments pertain to an improved electrostatographic imaging member comprising an interfacial layer further comprising an opaque semi-crystalline polyester resin that is also a hot-melt adhesive to prevent light transmission to the substrate and thus significantly reduce "plywood effect," a print quality defect.

17 Claims, 2 Drawing Sheets

U.S. PATENT DOCUMENTS

| | | | | |
|---|---|---|---|---|
| 5,958,638 | A | 9/1999 | Katayama et al. | |
| 6,048,658 | A | 4/2000 | Evans et al. | |
| 6,214,514 | B1 | 4/2001 | Evans et al. | |
| 6,416,389 | B1 | 7/2002 | Perry et al. | |
| 6,582,872 | B2 | 6/2003 | Willnow et al. | |
| 7,314,812 | B2 | 1/2008 | Wang | |
| 2007/0298340 | A1 * | 12/2007 | Mishra et al. | 430/58.8 |
| 2010/0068636 | A1 * | 3/2010 | Aziz et al. | 430/58.8 |

* cited by examiner

PHOTORECEPTOR INTERFACIAL LAYER

BACKGROUND

The presently disclosed embodiments relate generally to layers that are useful in imaging apparatus members and components, for use in electrostatographic, including digital, apparatuses. More particularly, the embodiments pertain to an improved electrostatographic imaging member comprising an interfacial layer further comprising a semi-crystalline polyester resin to prevent light transmission to the substrate and thus significantly reduce "plywood effect," a print quality defect.

In electrophotographic or electrostatographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrostatographic copying process is well known and is commonly used for light lens copying of an original document. Analogous processes also exist in other electrostatographic printing applications such as, for example, digital laser printing or ionographic printing and reproduction where charge is deposited on a charge retentive surface in response to electronically generated or stored images.

To charge the surface of a photoreceptor, a contact type charging device has been used. The contact type charging device includes a conductive member which is supplied a voltage from a power source with a D.C. voltage superimposed with a A.C. voltage of no less than twice the level of the D.C. voltage. The charging device contacts the image bearing member (photoreceptor) surface, which is a member to be charged. The outer surface of the image bearing member is charged with the rubbing friction at the contact area. The contact type charging device charges the image bearing member to a predetermined potential. Typically the contact type charger is in the form of a roll charger such as that disclosed in U.S. Pat. No. 4,387,980, the relative portions thereof incorporated herein by reference.

Multilayered photoreceptors or imaging members have at least two layers, and may include a substrate, a conductive layer, an optional undercoat layer (sometimes referred to as a "charge blocking layer" or "hole blocking layer"), an optional adhesive layer (sometimes referred to as an "interfacial layer"), a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Coherent illumination is used in electrophotographic printing for image formation on photoreceptors. Unfortunately, the use of coherent illumination sources in conjunction with multilayered photoreceptors results in the "plywood effect," also known as "interference fringe effect." This defect consists of a series of dark and light interference patterns that occur when the coherent light is reflected from the interfaces that pervade multilayered photoreceptors. In organic photoreceptors, primarily the reflection from the undercoat layer or charge blocking layer/substrate interface (e.g., substrate surface) or the reflected light from the undercoat layer (or charge blocking layer)/charge generating layer interface account for the interference fringe effect. The effect can be eliminated if the strong undercoat layer surface reflection or the strong substrate surface reflection is eliminated or suppressed.

While there have been attempts to reduce plywood effect in xerography, for example, as disclosed in U.S. Pat. Nos. 5,051,328, 5,089,908, 5,096,792, 5,139,907, 5,162,183, 5,210,548, 5,215,839, 5,302,485, 5,460,911, 5,635,324, 6,048,658, 6,214,514, 6,416,389, 6,582,872, and 7,314,812, hereby incorporated by reference, those methods were either too costly or had low efficiency in solving the interference problem.

Thus, there is a need for a low-cost, practically implementable and improved imaging layer that does not suffer from the above-described problems.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

SUMMARY

According to aspects illustrated herein, there is provided an imaging member comprising a substrate, a charge blocking layer disposed on the substrate, an interfacial layer disposed on the charge blocking layer, and an imaging layer disposed on the interfacial layer, wherein the interfacial layer comprises a semi-crystalline polyester resin such that light interference from the substrate is substantially reduced.

In another embodiment, there is provided an imaging member comprising a substrate, a charge blocking layer disposed on the substrate, an interfacial layer disposed on the charge blocking layer, and an imaging layer disposed on the interfacial layer, wherein the interfacial layer comprises a semi-crystalline polyester resin dispersed throughout the interfacial layer and the imaging member exhibits from about 0 to about 2 percent light transmission in visible light range.

Yet another embodiment, there is provided an image forming apparatus for forming images on a recording medium comprising (a) an imaging member having a charge retentive-surface for receiving an electrostatic latent image thereon, wherein the imaging member comprises a substrate, a charge blocking layer disposed on the substrate, an interfacial layer disposed on the charge blocking layer, and an imaging layer disposed on the interfacial layer, wherein the interfacial layer comprises a semi-crystalline polyester resin dispersed throughout the interfacial layer such that light interference from the substrate is substantially reduced, (b) a development component for applying a developer material to the charge-retentive surface to develop the electrostatic latent image to form a developed image on the charge-retentive surface, (c) a transfer component for transferring the developed image from the charge-retentive surface to a copy substrate, and (d) a fusing component for fusing the developed image to the copy substrate.

BRIEF DESCRIPTION OF THE DRAWINGS

For a better understanding, reference may be made to the accompanying figures.

DETAILED DESCRIPTION

Figure 1:
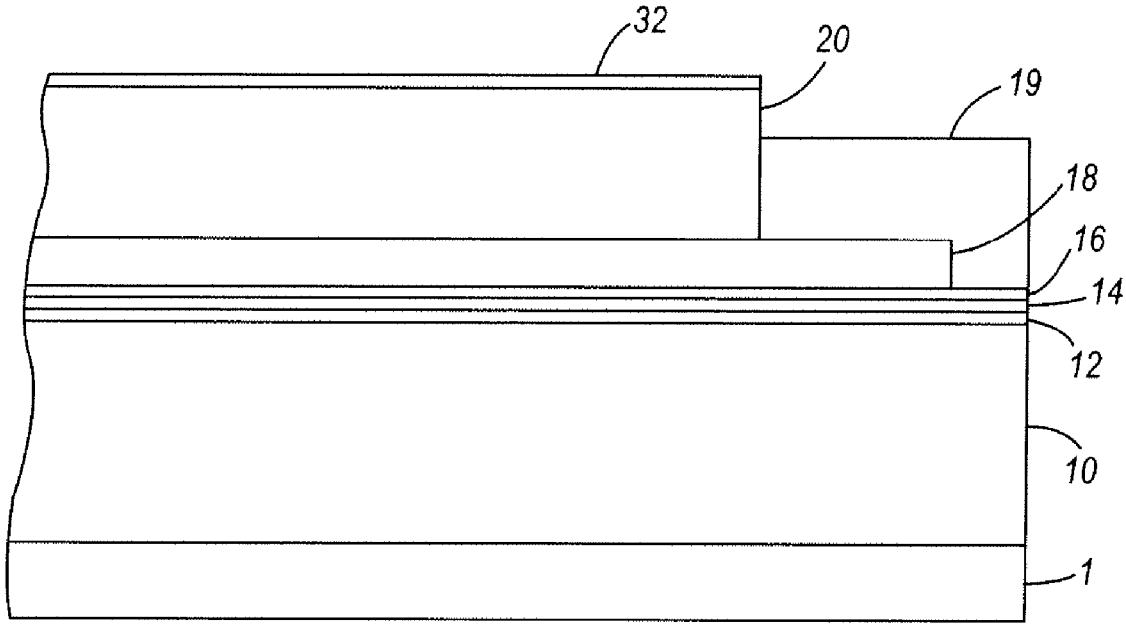
FIG. 1 is a cross-sectional view of an imaging member in a belt configuration according to the present embodiments.
Figure 2:
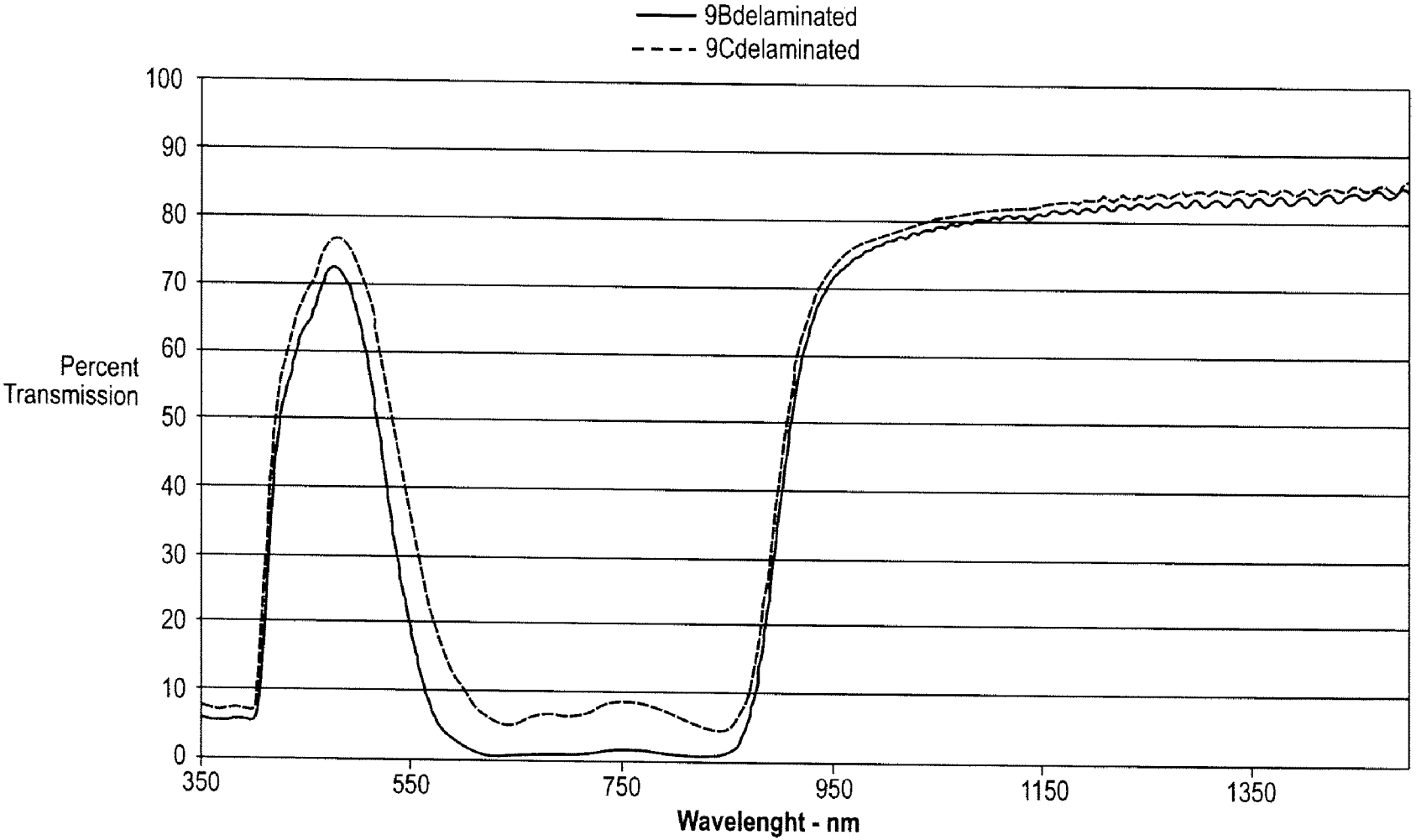
FIG. 2 is a graph illustrating reduced light interference or plywood effect in imaging members made according to the present embodiments.

In the following description, reference is made to the accompanying drawings, which form a part hereof and which illustrate several embodiments. It is understood that other embodiments may be used and structural and operational changes may be made without departure from the scope of the present disclosure.

The presently disclosed embodiments are directed generally to an improved electrostatographic imaging member comprising an interfacial layer further comprising a hot-melt adhesive semi-crystalline polyester resin to improve performance. In particular, the interfacial layer of the present embodiments helps prevent light interference and significantly reduces print quality defects due to plywood effect in imaging members.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

FIG. 1 shows an imaging member having a belt configuration according to the embodiments. As shown, the belt configuration is provided with an anti-curl back coating 1, a supporting substrate 10, an electrically conductive ground plane 12, an undercoat layer 14, an adhesive layer (also referred to an interfacial layer) 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference. Organic photoreceptors usually comprise a metalized substrate, undercoat layer, charge generation layer (CGL) and charge transport layer (CTL), sequentially. To form a latent image on the surface of photoreceptor, a charged photoreceptor has to be exposed by light, which usually is a laser with wavelength in visible light range. The ideal situation would be one in which the charge generation layer could absorb all the incident photons and no exposure light could penetrate through the CGL. In reality, however, there is always a small amount of light that passes through the CGL and UCL, and is then reflected back through the photoreceptor. This light interference results in a print defect.

The print defects manifest in full page mid-density gray areas which have a pattern that resembles the grain in a sheet of plywood. The cause was identified as a modulation of the amount of light reaching the generator layer due to the interference between the light reflected at the transport layer/air interface and the light reflected from the ground plane. There is always a top surface reflection due to the index of refraction difference. Some light is also reflected by the metal substrate, and the amount depends on the metal and the optical density of the charge generation layer at the laser wavelength (substrate light passes through the charge generation layer twice).

The amount of interference can be modified in several ways. First, the illuminator coherence can be changed. For example, a gas laser may be used rather than a diode laser or light-emitting diode (LED). Second, a reduction of the intensity of one beam may also modify interference. The reduction may be achieved by absorbing the substrate beam in the charge generation layer (e.g., more pigment), eliminate the surface reflection (e.g., Brewster angle illumination), use a light absorbing interface layer below the charge generation layer, use a low-reflection ground plane, or use an anti-reflection dielectric stack on top of the ground plane metal. Next, coherence may be broken up to modify interference. For example, scatter may be achieved from the top via a rough overcoat or a filled overcoat, or scatter may be achieved via the bulk of the charge transport layer (e.g., using polytetrafluoroethylene (PTFE) or silica filler), or scatter may be achieved via a filled interfacial layer under the charge generation layer. However, using any of the above approaches to solve the light interference problem must take into account the impact on the electrical properties of the resulting photoreceptors. Namely, many of the prior methods used to reduce plywood effect produced photoreceptors with very poor electrical properties. For example, many of the photoreceptors did not discharge at all.

The present embodiments resolve the plywood effect by using an interfacial layer having a specific composition. Namely, the interfacial layer comprises a semi-crystalline polyester adhesive resin rather than an amorphous polymer resin. The semi-crystalline polyester resin demonstrated effective blocking of light penetrating from the CGL to the metal substrate, thus preventing light interference problems. In particular embodiments, the interfacial layer comprises a hot-melt adhesive semi-crystalline polyester resin, HM-4185 (available from Bostik, Inc. Middleton, Mass.). The resulting photoreceptors perform with almost zero light transmission from the CGL to BLS, while excellent electrical properties.

In addition, changing the polymer resin used in the IFL does not require additional modification in conventional production process, and the hot-melt adhesive polyester resin is commercially available with much lower cost than the conventionally used amorphous polymer. The crystalline polyester resin, although identified as a hot-melt adhesive, is applied by dissolving in solvent and coated using extrusion die coating methods, followed by oven drying to remove the solvent(s).

The Overcoat Layer

Other layers of the imaging member may include, for example, an optional over coat layer 32. An optional overcoat layer 32, if desired, may be disposed over the charge transport layer 20 to provide imaging member surface protection as well as improve resistance to abrasion. In embodiments, the overcoat layer 32 may have a thickness ranging from about 0.1 micrometer to about 10 micrometers or from about 1 micrometer to about 10 micrometers, or in a specific embodiment, about 3 micrometers.

These overcoating layers may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof.

Overcoating layers may be continuous and have a thickness of at least about 0.5 micrometer, or no more than 10 micrometers, and in further embodiments have a thickness of at least about 2 micrometers, or no more than 6 micrometers.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 1, the belt can be seamed or seamless. In embodiments, the photoreceptor herein is in a drum configuration.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual voltage. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

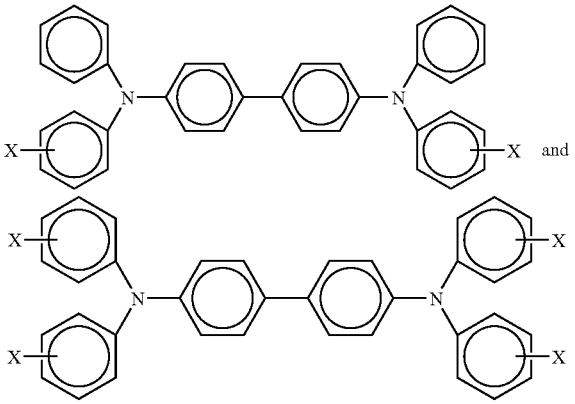

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

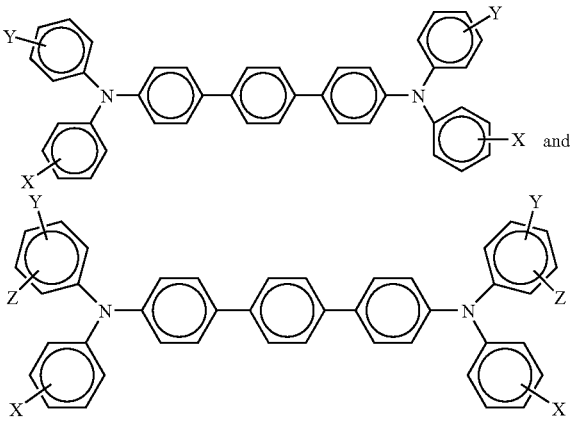

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate)methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER®) TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Adhesive Interfacial Layer

A separate adhesive interfacial layer 16 may be provided in certain configurations, such as for example, in flexible web configurations. In the embodiment illustrated in the FIG. 1, the interfacial layer would be situated between the blocking layer 14 and the charge generation layer 18. The interfacial layer may include a copolyester resin. Exemplary polyester resins which may be utilized for the interfacial layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interfacial layer may be applied directly to the hole blocking layer 14. Thus, the adhesive interfacial layer in embodiments is in direct contiguous contact with both the underlying hole blocking layer 14 and the overlying charge generator layer 18 to enhance adhesion bonding to provide linkage. In yet other embodiments, the adhesive interfacial layer is entirely omitted.

Any suitable solvent or solvent mixtures may be employed to form a coating solution of the polyester for the adhesive interfacial layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interfacial layer may have a thickness of at least about 0.01 micrometer, or no more than about 5 micrometers after drying. In embodiments, the dried thickness is from about 0.03 micrometer to about 1 micrometer.

In present embodiments, the interfacial layer comprises a semi-crystalline polyester resin to block the light penetrating from the CGL to the metal substrate, thus preventing plywood effect. In particular embodiments, the interfacial layer comprises a hot-melt adhesive and opaque semi-crystalline polyester resin. The semi-crystalline polyester is prepared by reacting adipic acid with ethylene glycol and 1,4-cyclohexanedimethanol, wherein adipic acid is present in an amount of from about 30 to about 70 mole percent, or from about 45 to about 55 mole percent; ethylene glycol is present in an amount of from about 1 to about 20 mole percent, or from about 5 to about 15 mole percent; and 1,4-cyclohexanedimethanol is present in an amount of from about 20 to about 60 mole percent, or from about 35 to about 50 mole percent of the polyester. The number average molecular weight of the semi-crystalline polyester is from about 10,000 to about 100,000, or from about 20,000 to about 50,000; and the weight average molecular weight of the semi-crystalline polyester is from about 30,000 to about 300,000, or from about 50,000 to about 150,000.

Specific examples of the semi-crystalline polyesters include HM-4185 ($M_n$=21,000 and $M_w$=71,000), available from Bostik, Inc. Middleton, Mass. Other suitable resins include HM-4170 ($M_n$=22,000 and $M_w$=71,000), available from Bostik, Inc. Middleton, Mass., mixtures thereof, and the like.

The resin is dissolved in an organic solvent such as tetrahydrofuran (THF) and then coated as IFL on a silane charge blocking layer (BLS). Other suitable solvents include toluene, monochlorobenzene, methylene chloride, cyclohexanone, mixtures thereof, and the like. The IFL may be coated using extrusion die coating methods, followed by oven drying to remove the solvent(s). The resulting interfacial layer comprising the semi-crystalline polyester may have a thickness of at least about 0.01 micrometer, or no more than about 2 micrometers after drying. In embodiments, the dried thickness is from about 0.03 micrometer to about 0.5 micrometer.

The resulting photoreceptors perform with almost zero light transmission from the CGL to the metal substrate, while excellent electrical properties, such as low Vr (residual potential after light erase), low $V_{depl}$ (a linearly extrapolated value from the surface potential versus charge density relation of the device, and is a measurement of voltage leakage during charging), low $V_{dd}$ (lost potential before light exposure) and stable cycling, are maintained. In embodiments, the photoreceptors exhibit only from about 0 to about 2 percent transmission in visible light range.

The Ground Strip

The ground strip may comprise a film forming polymer binder and electrically conductive particles. Any suitable electrically conductive particles may be used in the electrically conductive ground strip layer 19. The ground strip 19 may comprise materials which include those enumerated in U.S. Pat. No. 4,664,995. Electrically conductive particles include carbon black, graphite, copper, silver, gold, nickel, tantalum, chromium, zirconium, vanadium, niobium, indium tin oxide and the like. The electrically conductive particles may have any suitable shape. Shapes may include irregular, granular, spherical, elliptical, cubic, flake, filament, and the like. The electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness of at least about 7 micrometers, or no more than about 42 micrometers, or of at least about 14 micrometers, or no more than about 27 micrometers.

The Anti-Curl Back Coating Layer

The anti-curl back coating 1 may comprise organic polymers or inorganic polymers that are electrically insulating or slightly semi-conductive. The anti-curl back coating provides flatness and/or abrasion resistance.

Anti-curl back coating 1 may be formed at the back side of the substrate 2, opposite to the imaging layers. The anti-curl back coating may comprise a film forming resin binder and an adhesion promoter additive. The resin binder may be the same resins as the resin binders of the charge transport layer discussed above. Examples of film forming resins include polyacrylate, polystyrene, bisphenol polycarbonate, poly(4,4'-isopropylidene diphenyl carbonate), 4,4'-cyclohexylidene diphenyl polycarbonate, and the like. Adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl back coating is at least about 3 micrometers, or no more than about 35 micrometers, or about 14 micrometers.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Fabrication of Improved Photoreceptor

There was coated a 0.02 micron thick titanium layer on the biaxially oriented polyethylene naphthalate substrate (KALEDEX™ 2000) having a thickness of 3.5 mils, and applying thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive interfacial layer was then prepared by applying a wet coating over the blocking layer using a gravure applicator or an extrusion coater, and which adhesive contained 1 percent by weight based on the total weight of the solution of the polyester adhesive (HM-4185, available from Bostik, Inc. Middleton, Mass.) in tetrahydrofuran. The adhesive layer was then dried for about 1 minute at 120° C. in the forced air dryer. The resulting adhesive layer had a dry thickness of 200 Angstroms.

A charge generating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V) and 300 grams of ⅛ inch (3.2 millimeters) diameter stainless steel shot. This mixture was then placed on a ball mill for 8 hours. Subsequently, 2.25 grams of PCZ-200 were dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a gravure applicator or an extrusion coater to form a charge generating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the known ground strip layer that was applied later. The charge generating layer was dried at 120° C. for 1 minute in a forced air oven to form a dry charge generating layer having a thickness of 0.4 micrometer.

The photoreceptor imaging member web was then coated over with a single pass charge transport layer. Specifically, the charge generating layer was overcoated with a charge transport layer in contact with the charge generating layer. The charge transport layer was prepared by introducing into an amber glass bottle in a weight ratio of 1:1 N,N'-diphenyl-N,N'-bis(3-methylphenyl)-1,1'-biphenyl-4,4'-diamine, and poly(4,4'-isopropylidene diphenyl)carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15 percent by weight solids. This solution was applied on the charge generating layer to form the charge transport layer coating that upon drying (120° C. for 1 minute) had a thickness of 29 micrometers. During this coating process, the humidity was equal to or less than 15 percent.

For comparison, a control photoreceptor was also prepared by repeating the above procedures with a different IFL. In the inventive device (9B), the IFL was semi-crystalline polyester resin HM-4185, while the IFL in control device (9C) was amorphous polyester resin ARDEL™ D100 available from Toyota Hsutsu Inc.

Electrical Property Test:

The photoreceptor devices were submitted for electrical property test by a 4000 scanner. The test results were summarized in the Table 1 below. The inventive photoreceptor device showed very low photo-induced discharge residual voltage (Vr), low charging depletion ($V_{depl}$) and low dark decay voltage ($V_{dd}$). Furthermore, electrical performance of the inventive photoreceptor in 10 k cycling test was also very stable. The two tested photoreceptor devices matched well in electrical performance. Thus, the modification in IFL does not negatively impact the electrical properties of photoreceptor device in any way.

TABLE 1

| Sample ID | IFL | $V_r$ (V) | $V_{depl}$ (V) | $V_{dd}$ (V) |
|---|---|---|---|---|
| 9B | HM4185 | 36.4 | 81.2 | 37.6 |
| 9C | Ardel | 31.7 | 98.5 | 32.0 |
| After 10k cycling | | | | |
| 9B | HM4185 | 61.2 | 128.1 | 26.3 |
| 9C | Ardel | 54.6 | 119.9 | 37.5 |

Optical Property Test:

The transmission of the photoreceptor devices were measured and shown in FIG. 3. As can be seen in FIG. 3, Sample 9B with the crystalline hot-adhesive resin in the IFL had near zero transmission in visible light range, which is a very good indicator in solving light reflection problems, such as the plywood effect.

Adhesion Test:

A back-peel test on the samples in the laboratory showed no difference for adhesion. Thus, the hot-melt adhesive crystalline polyester resin does not negatively impact the function of the interfacial layer for the photoreceptor.

In Summary, a crystalline polyester hot-adhesive resin in the IFL has been demonstrated to show very good results in preventing plywood effect caused by light reflection. Moreover, the experimental data shows that this crystalline resin did not negatively impact the electrical properties of photoreceptor device. Thus, use of the hot-adhesive resin as the IFL layer resolves light interference and serves the function of an interfacial adhesive layer well. Lastly, the hot-adhesive resin is a low-cost polymer material and no process change is necessary for implementing the inventive IFL.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising a substrate;

a charge blocking layer disposed on the substrate;

an interfacial layer disposed on the charge blocking layer; and an imaging layer disposed on the interfacial layer, wherein the interfacial layer comprises a semi-crystalline polyester resin that is a reaction product of adipic acid, ethylene glycol and 1,4-cyclohexanedimethanol, such that light interference from the substrate is substantially reduced; wherein the adipic acid is present in an amount of from about 30 to about 70 mole percent, the ethylene glycol is present in an amount of from about 1 to about 20 mole percent, and the 1,4-cyclohexanedimethanol is present in an amount of from about 20 to about 60 mole percent, and the total is 100 percent.

2. The imaging member of claim 1, wherein the resin is a hot-melt adhesive.

3. The imaging member of claim 1, wherein the adipic acid is present in an amount of from about 45 to about 55 mole percent, the ethylene glycol is present in an amount of from about 5 to about 15 mole percent, and the 1,4-cyclohexanedimethanol is present in an mount of from about 25 to about 45 mole percent, and the total is 100 percent.

4. The imaging member of claim 1, wherein the polyester resin possesses a number average molecular weight of from about 10,000 to about 100,000, and a weight average molecular weight of from about 30,000 to about 300,000.

5. The imaging member of claim 4, wherein the polyester resin possesses a number average molecular weight of from about 20,000 to about 50,000, and a weight average molecular weight of from about 50,000 to about 100,000.

6. The imaging member of claim 1, wherein the interfacial layer is formed from a coating comprising the resin dissolved in an organic solvent.

7. The imaging member of claim 6, wherein the solvent is selected from the group consisting of tetrahydrofuran, toluene, monochlorobenzene, methylene chloride, cyclohexanone, and mixtures thereof.

8. The imaging member of claim 1, wherein the charge blocking layer is a silane charge blocking layer.

9. The imaging member of claim 1, wherein the interfacial layer has a thickness of from about 0.01 micrometer to about 2.0 micrometers.

10. An imaging member comprising a substrate;

a charge blocking layer disposed on the substrate;

an interfacial layer disposed on the charge blocking layer; and an imaging layer disposed on the interfacial layer, wherein the interfacial layer comprises a semi-crystalline polyester resin that is a reaction product of adipic acid, ethylene glycol and 1,4-cyclohexanedimethanol dispersed throughout the interfacial layer and the imaging member exhibits from about 0 to about 2 percent light transmission in visible light range; wherein the adipic acid is present in an amount of from about 30 to about 70 mole percent, the ethylene glycol is present in an amount of from about 1 to about 20 mole percent, and the 1,4-cyclohexanedimethanol is present in an amount of from about 20 to about 60 mole percent, and the total is 100 percent.

11. The imaging member of claim 10, wherein the resin is a holt-melt adhesive.

12. An image forming apparatus for forming images on a recording medium comprising:

a) an imaging member having a charge retentive-surface for receiving an electrostatic latent image thereon, wherein the imaging member comprises a substrate, a charge blocking layer disposed on the substrate, an interfacial layer disposed on the charge blocking layer, and an imaging layer disposed on the interfacial layer, wherein the interfacial layer comprises a semi-crystalline polyester resin that is a reaction product of adipic acid, ethylene glycol and 1,4-cyclohexanedimethanol dispersed throughout the interfacial layer such that light interference from the substrate is substantially reduced; wherein the adipic acid is present in an amount of from about 30 to about 70 mole percent, the ethylene glycol is present in an amount of from about 1 to about 20 mole percent, and the 1,4-cyclohexanedimethanol is present in an amount of from about 20 to about 60 mole percent, and the total is 100 percent;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

13. The image forming apparatus of claim 12, wherein the imaging member exhibits from about 0 to about 2 percent light transmission in visible light range.

14. The imaging forming apparatus of claim 12, wherein the polyester resin possesses a number average molecular weight of from about 10,000 to about 100,000, and a weight average molecular weight of from about 30,000 to about 300,000.

15. The imaging forming apparatus of claim 12, wherein the interfacial layer is formed from a coating comprising the resin dissolved in an organic solvent and the solvent is selected from the group consisting of tetrahydrofuran, toluene, monochlorobenzene, methylene chloride, cyclohexanone, and mixtures thereof.

16. The imaging forming apparatus of claim 12, wherein the charge blocking layer is a silane charge blocking layer.

17. The imaging forming apparatus of claim 12, wherein the interfacial layer has a thickness of from about 0.01 micrometer to about 2.0 micrometers.

* * * * *